US005249713A

United States Patent [19]

Reich et al.

[11] Patent Number: 5,249,713

[45] Date of Patent: Oct. 5, 1993

[54] PUMP VALVE ASSEMBLY

[75] Inventors: Uwe Reich, Hagen; Peter Runte, Unna-Hemmerde, both of Fed. Rep. of Germany

[73] Assignee: Perfect-Valois Ventil GmbH, Dortmund-Wickede, Fed. Rep. of Germany

[21] Appl. No.: 745,515

[22] Filed: Aug. 15, 1991

[30] Foreign Application Priority Data

Aug. 16, 1990 [DE] Fed. Rep. of Germany ..... 9011901

[51] Int. Cl.[5] ..... B65D 83/14

[52] U.S. Cl. ..... 222/321; 222/402.13; 222/402.15

[58] Field of Search ..... 222/320, 321, 182, 383, 222/472, 402.13, 402.15, 472, 507, 570; 239/333, 154

[56] References Cited

U.S. PATENT DOCUMENTS

| | | | |
|---|---|---|---|
| 3,146,916 | 9/1964 | Kronheim | 222/182 |
| 3,227,321 | 1/1966 | Sagarin | 222/402.13 |
| 3,429,484 | 2/1969 | Baldwin | 222/402.13 |
| 3,611,820 | 10/1971 | Hempel | 74/102 |
| 3,987,942 | 10/1976 | Morane et al. | 222/402.15 |
| 4,186,855 | 2/1980 | Edman et al. | 222/321 |
| 4,264,037 | 4/1981 | Nozawa | 222/321 |
| 4,773,571 | 9/1988 | Hagan et al. | 222/402.15 |
| 5,139,180 | 8/1982 | Lucas | 222/402.13 |

FOREIGN PATENT DOCUMENTS

| | | |
|---|---|---|
| 2086558 | 12/1971 | France . |
| 1333832 | 8/1973 | United Kingdom . |

*Primary Examiner*—Andres Kashnikow
*Assistant Examiner*—Philippe Derakshani
*Attorney, Agent, or Firm*—Dressler, Goldsmith, Shore, Sutker & Milnamow, Ltd.

[57] ABSTRACT

Package comprising a liquid receptacle and a hand pump arranged thereon, the actuating and dispensing head of which, which can be operated counter to the action of a compression spring, is provided with an outlet opening for the liquid. A protective cap is detachably secured on the upper side of the liquid receptacle. Secured swivelably in the protective cap is a pump-actuated lever. The actuating lever extends from its swiveling spindle in the protective cap to beyond the dispensing head of the pump. The free lever end is angled in the direction of the receptacle lid. The protective cap is provided in the region of the free lever end with an opening into which the actuating lever at least projects. At the top, the dispensing head is connected with the actuating lever in such a way that it is non-rotatable but axially movable; its outlet opening is in alignment with a passage opening in the protective cap. The package is easy to handle and space-saving.

7 Claims, 4 Drawing Sheets

PUMP VALVE ASSEMBLY

FIELD OF THE INVENTION

The invention relates to a pump valve assembly removably mounted to a liquid receptacle.

BACKGROUND OF THE INVENTION

The object on which the invention is based is to improve a package of this known generic type in such a way that the shaping of the package permits comfortable handling and easy operation of the hand pump, the package being of compact and therefore space-saving configuration even in the unactuated state.

The invention achieves this object by means of the features described and illustrated in the application.

SUMMARY OF THE INVENTION

By virtue of the fact that the actuating lever is arranged in the protective cap detachable from the liquid receptacle and is actuable in the region of the opening in the protective cap, it is ensured that the actuating lever protrudes laterally only slightly, if at all, beyond the circumference of the protective cap, with the result that the package does not take up any additional space for the free, angled lever end, the latter permitting easier operation of the hand pump. The positive connection between the actuating lever and the top side of the actuating and dispensing head of the hand pump at the same time guarantees perfect alignment of the dispensing opening of the dispensing head relative to the passage opening in the protective cap, excluding defective dispensing of the liquid contained in the receptacle.

Due to the design of the passage opening in the circumferential surface of the protective cap as a vertical elongate hole, the liquid can be dispensed satisfactorily in any stroke position of the actuating and dispensing head.

By virtue of the elliptical cross-section of the protective cap and liquid receptacle with the passage opening in one of the two main sides of the protective cap, the package is very handy.

The design of the opening as an oval aperture in the narrow side of the protective cap represents an embodiment in which the lever end projects into the aperture but does not protrude beyond the outline of the protective cap. This is the most space-saving embodiment of the package according to the invention, in which the protective cap also fulfills its protective function to the greatest extent.

In a further embodiment, the opening comprises a slot which extends essentially over the height of one narrow side of the protective cap. This embodiment permits variable shaping of the lever end and of its swiveling range.

Yet another embodiment has a slot in the protective cap which extends over one narrow side and the top wall to below the swiveling spindle of the actuating lever on the other narrow side of the receptacle. The protective cap here imposes no limit on the swiveling range and design of the actuating lever.

Further expedient developments of the invention are likewise contained in the subclaims.

The invention is explained in greater detail below with reference to the schematic drawings of a plurality of illustrative embodiments. In the drawings:

DETAILED DESCRIPTION

Figure 1:
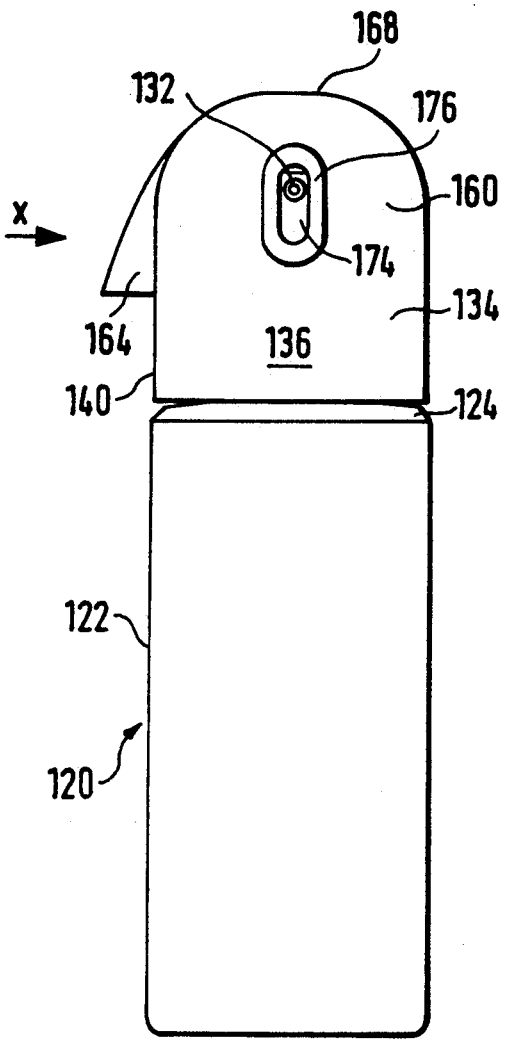
FIG. 1 shows a first embodiment of a package in front view with an actuating lever in the rest position.

Depicted in FIGS. 1 to 5 is a package 120, the receptacle 122 of which preferably consists of plastic and serves to accommodate liquids or flowable material, such as cosmetic liquids or lotions etc. As seen in plan view, the receptacle 122 has an approximately oval or elliptical shape, as can be seen from FIG. 3. The top side of the receptacle 122, which is formed by a lid 124, is provided with a neck 126, the outside of which has, in a manner known per se, a screw thread (not shown). The screw thread interacts with a screw cap 128 which contains, in a manner known per se, a hand pump (not shown) which is connected in customary fashion, via an immersion tube (not shown) to the interior of the receptacle and the tubular piston skirt (not visible) of which protrudes from the top side of the screw cap 128 and bears an actuating or dispensing head 130 for the pump. The liquid in the receptacle can be pumped out of the receptacle 122 via a lateral outlet opening 132 of the dispensing head 130.

Seated on the receptacle neck 126 is a protective cap 134, the horizontal cross-section of which corresponds essentially to that of the receptacle 122. The protective cap 134, which preferably consists of plastic, has a front and rear main side 136 and 138 respectively and two narrow sides 140 and 142 respectively. A central longitudinal bore 144 has an annular snap-in groove 146 at the lower end for the engagement of an annular bead 148 which is arranged at the lower end of the receptacle neck 126. The central longitudinal bore 144 makes a transition to a smaller-diameter bore 152, in the process forming an annular face 150, the said bore 152 corresponding approximately to the diameter of an upper, sleeve-shaped end 154 of the screw cap 128 and engaging over the oblique shoulder 156 of the latter. According to FIG. 2, the protective cap is provided with a slot 166 which extends over the narrow side 140 and the entire top wall 168 into the upper region of the narrow side 142 of the protective cap 134 (FIGS. 4, 5).

A swiveling spindle 160 of the actuating lever 158 is arranged in the upper region of the closed narrow side 142 of the protective cap 134 above a cap wall 162, at a height which is slightly below the outlet opening 132 in FIG. 4. From its swiveling spindle 160 in the protective cap 134, the actuating lever 158 extends beyond the actuating and dispensing head 130 of the pump. Its free lever end 164 is then angled in the direction of the receptacle lid 124. From FIG. 1 it can be seen that, in the rest position of the actuating lever 158, the outer contour of the latter corresponds to that of the protective cap 134, with the exception of the lever end 164, which protrudes laterally through a slot 166 and the outer contour of which, as FIG. 1 shows, makes a transition to the curvature of the top wall 168 of the protective cap 134 and projects furthest from the narrow side 140 of the protective cap 134 at its free lower end 164. As a result, the lever end can be grasped easily with one or two fingers in order to operate the hand pump of the package and pressed into the interior of the protective cap 134 in order to execute the pump stroke. The final stroke position of the lever end 164 can be seen from FIG. 5, in which the lever end 164 disappears completely in the lateral slot 166 of the protective cap 134.

Figure 2:
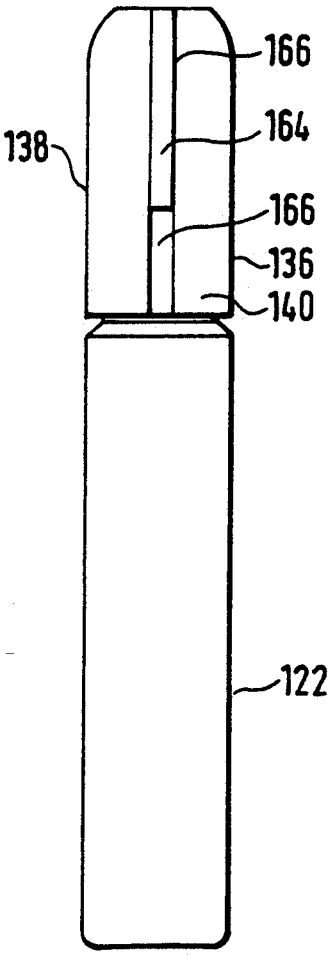
FIG. 2 shows a view of the package in FIG. 1 from the left, in the direction of arrow x.
Figure 3:
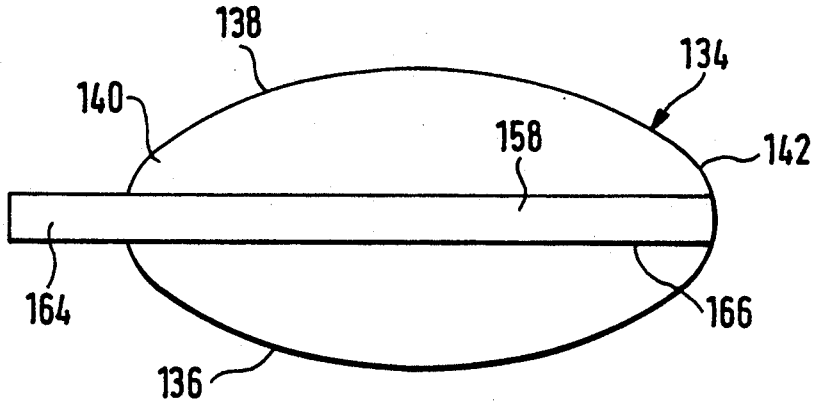
FIG. 3 shows a plan view of the package in FIG. 1, on an enlarged scale.

It can furthermore be seen from FIGS. 2 and 3 that the plane of in which motion of the actuating lever 158 and the diametrical slot 166 of the protective cap 134 is located extends in the principal plane of the receptacle 122 and the protective cap 134. The width of the slot 166 corresponds approximately to that of the actuating lever 158 or of its lever end 164.

Figure 4:
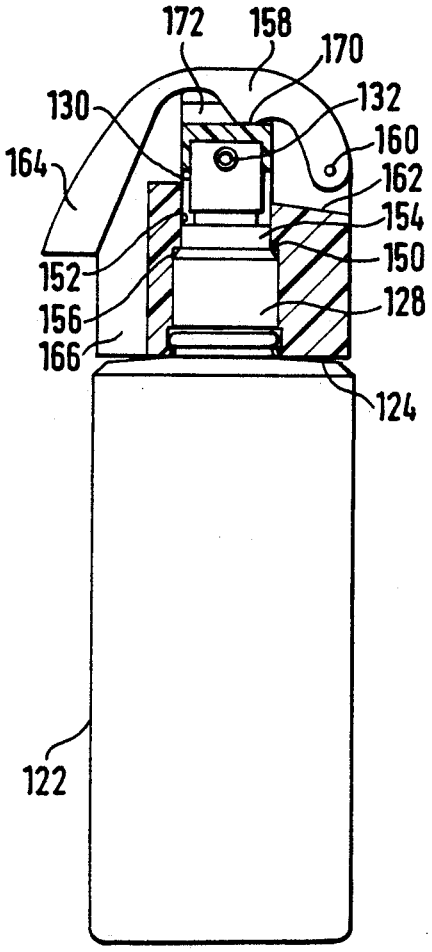
FIG. 4 shows the package in FIG. 1 in partially cut-away representation of the protective cap, the actuating lever being in the rest position in accordance with FIG. 1.
Figure 5:
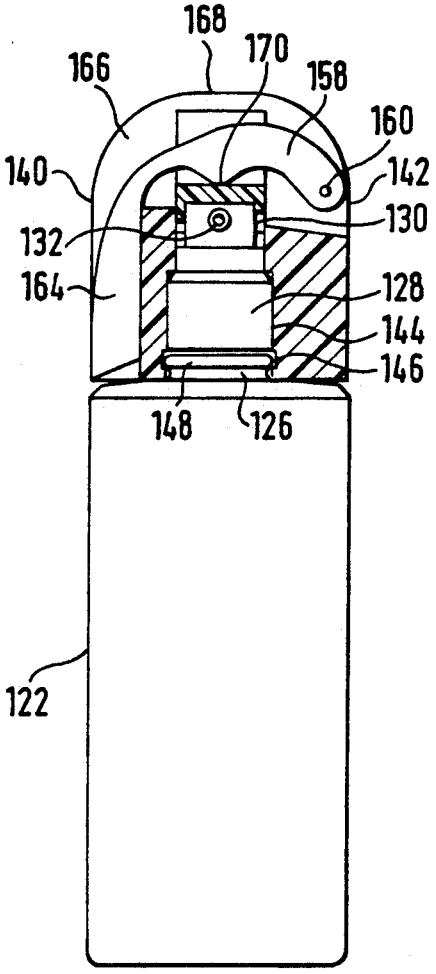
FIG. 5 shows the package shown in FIG. 4 with the actuating lever in the end position of its actuating stroke.
Figure 6:
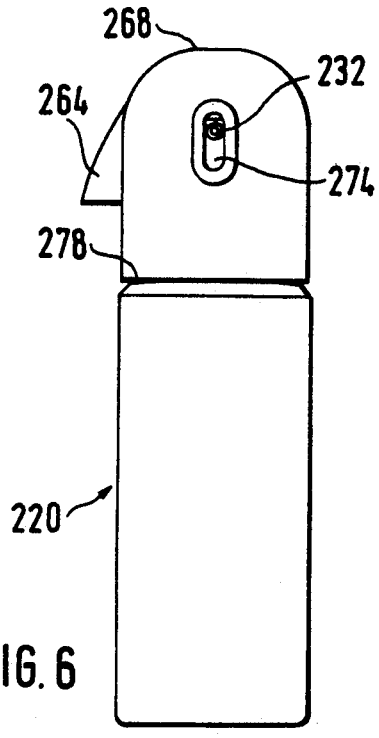
FIG. 6 shows the front view of a second embodiment of a package.
Figure 7:
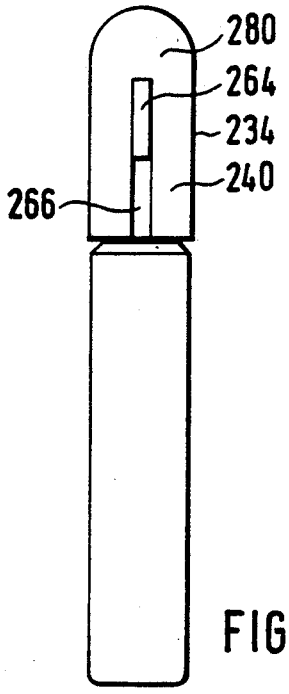
FIG. 7 shows a view of the package in FIG. 6 from the left, in the direction of arrow x, with the free end of an actuating lever.

The underside of the actuating lever 158 is provided with a control cam 170 which engages in a groove 172 on the topside of the dispensing head 130 (FIGS. 4, 5). As a result, the outlet opening 132 of the dispensing head 130, which outlet opening is directed at right angles to the swiveling plane of the actuating lever 158, is always unequivocally guaranteed by the positive engagement of the actuating lever 158 in the diametrical groove 172 with the dispensing head 130. As seen from the outside, the outlet opening 132 therefore always lies behind a passage opening 174 in the front main side 136 of the protective cap 134 (FIG. 1). This passage opening 174 is designed as an elongate hole which extends in the vertical direction and the length of which corresponds to the travel of the dispensing head 130, allowing the liquid emerging from the outlet opening 132 to emerge through the passage opening 174 of the protective cap 134 in any stroke position of the dispensing head. FIG. 1 further indicates that the horizontal cross-section of the passage opening 174 in the protective cap 134 widens towards the outside of the protective cap 134. This outward-widening rim of the passage opening 174 is denoted in FIG. 1 by 176.

Figure 8:
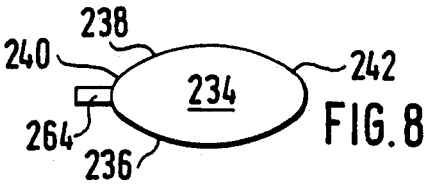
FIG. 8 shows a plan view of the package in FIG. 6.
Figure 9:
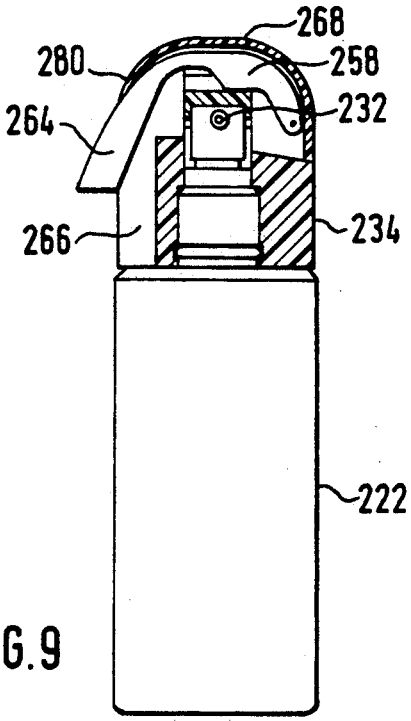
FIG. 9 shows a view of the package as in FIG. 6 but in partially cut-away representation of the protective cap with the actuating lever in the rest position.
Figure 10:
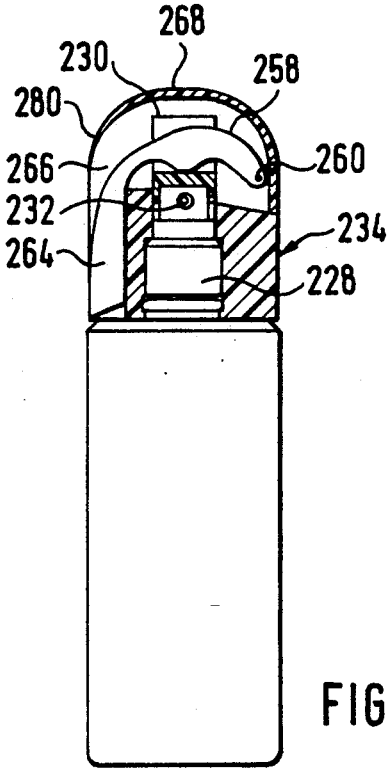
FIG. 10 shows the representation of the package as in FIG. 9 but with the actuating lever in the end position of the actuating stroke.

FIGS. 6 to 10 illustrate a second embodiment of a package 220 according to the invention, in which only the protective cap 234 and the opening provided therein for an actuating lever 258 differ from the first embodiment. The parts which are similar to those in the first embodiment are therefore provided with reference numerals in which the first number is replaced by the number 2. In particular, a protective cap 234 can be seen, the opening of which, in a narrow side 240, comprises a slot 266 which corresponds approximately to the width of the actuating lever 258 and extends from the lower rim 278 of the protective cap 234 approximately as far as the top wall 268 of the protective cap 234. Here too, the free lever end 264 protrudes outwards through the slot 266, making the first and second embodiment similar in the view according to FIGS. 1 and 6. The slot 266 is bounded by an upper rim 280, against which the lever end 264 does not bear in its rest position under the action of the return spring (not shown) of the hand pump of the receptacle 222, the said spring acting on the dispensing head 230. In this second embodiment too, the outer side of the lever end 264 is flush with the outer contour of the protective cap 234 in the end position of its actuating stroke, as FIG. 10 shows. FIGS. 8 to 10 show clearly that the top wall 268 of the protective cap 234 is completely closed and, in the rest position, the lever end 264 protrudes beyond the outer contour of the protective cap 234 at the narrow side 240 to an extent corresponding to the travel of the dispensing head 230.

Figure 11:
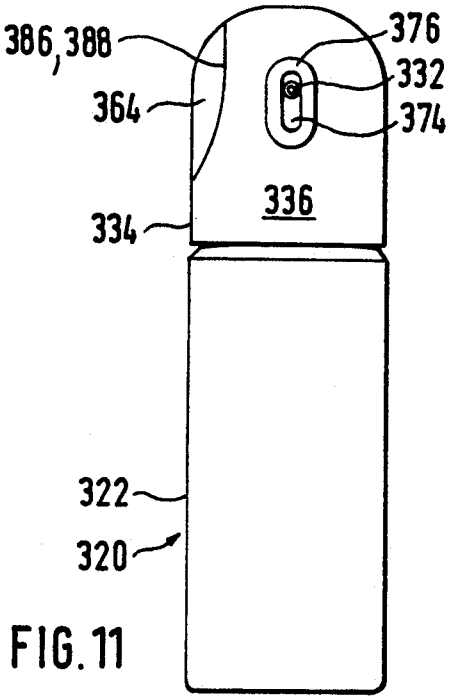
FIG. 11 shows a third embodiment of a package in front view.
Figure 14:
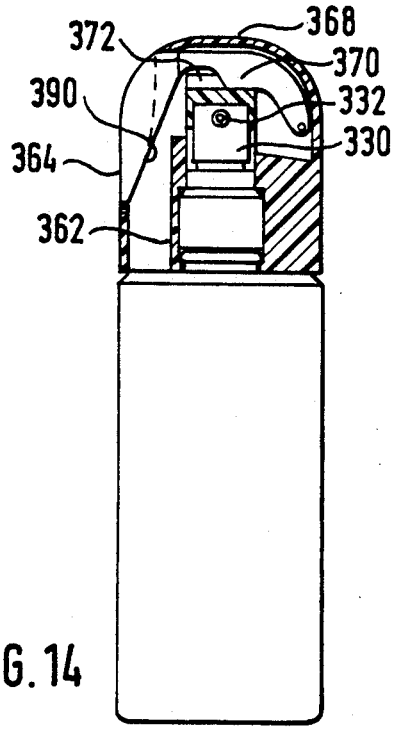
FIG. 14 shows a view of the package similar to that in FIG. 11 but in partially cut-away representation of the protective cap with the actuating lever in the rest position and FIG. 15 shows the package according to 14 with the actuating lever in the end position of its actuating stroke

FIGS. 11 to 14 depict a third embodiment of a package 230 according to the invention, in which those parts which are identical or similar to the embodiments described above are provided with reference numerals in which the first number is simply replaced by a 3. Here, a liquid receptacle 322 is provided with a protective cap 334, the narrow side of which 340 has, in the region of the free end 364 of an actuating lever 358, an opening 366 into which the widened lever end 364 of the actuating lever 358 extends in such a way that, in its rest position, as FIGS. 11 and 14 show, it essentially fills the opening 366 but does not protrude beyond the contour of the protective cap 334.

Figure 12:
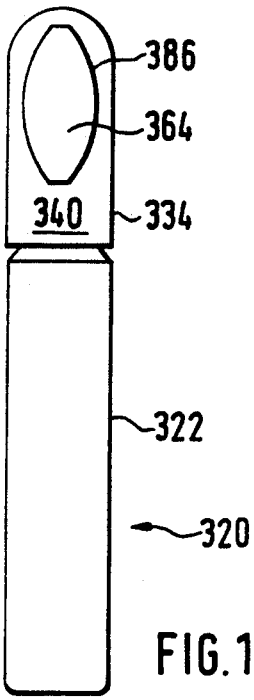
FIG. 12 shows the package according to FIG. 11 in a view from the left, in the direction of arrow x.
Figure 13:
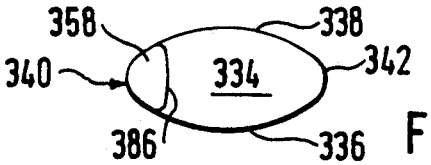
FIG. 13 shows a plan view of the package in FIG. 11.
Figure 15:
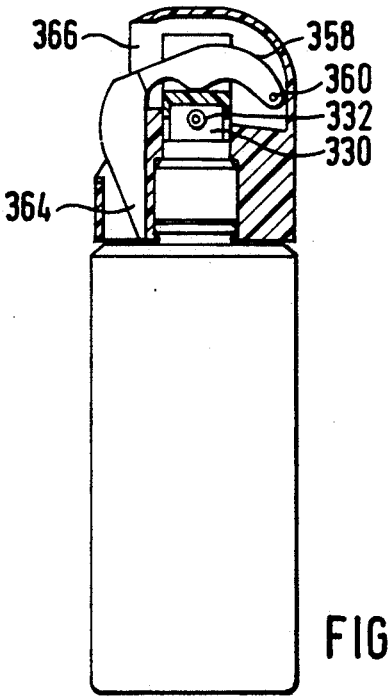

It is apparent that, in the view according to FIG. 12, the opening 366 in the protective cap 334 for the free lever end 364 corresponds to an essentially oval aperture 386, the aperture rim of which is cut in the form of an arc into the narrow side 340 and symmetrically into the two main sides 336 and 338 of the protective cap 334, as indicated in FIG. 11 by the arc-shaped cut 388 into main side 336. The depth of the arc-shaped cut 388, to which a correspondingly deep cut on main side 338 of the protective cap 334 thus corresponds, is dimensioned in such a way that, as FIG. 15 shows, the lever end 364 of the actuating lever 358 can be pressed completely into the protective cap 334, as far as the final stroke position of the dispensing head 330. In this position, the rectilinear rear side 390 rests against a vertical cap wall 362.

It is apparent that, in this third embodiment, the actuating lever 358 does not take up any additional space beyond the contours of the protective cap 334 and, while having a pleasant appearance, guarantees the full functioning ability of the package 320 with its pump.

We claim:

1. A pump assembly removably mounted to a liquid receptacle having a pump-type spray assembly secured thereto, which spray assembly contains an outlet opening which lies behind a passage opening for the liquid, said spray assembly comprising a protective cap having an elliptical cross section with narrow and main sides detachably secured to an upper portion of said receptacle and including therein a slidably supported actuating and dispensing head, said cap and dispensing head defining aligned outlet openings for the liquid, a pump actuating lever having a downwardly angled free lever end and a spray head engaging portion, means pivotally connecting the lever to said cap on the side of said cap opposite to the location of the free lever end of said pump actuating lever, which lever is positioned to engage said actuating and dispensing head upon pivotal movement thereof, said cap further defining an opening through which said lever extends, which opening corresponds in side view to an essentially oval aperture defined by an aperture rim that is cut in the form of an arc into a narrow side and the two main sides of the protective cap which is designed to prevent the lever from rotating while permitting pivotal movement thereof to actuate said dispensing head to spray liquid.

2. A pump assembly as claimed in claim 1 in which the dispensing heat passage opening in the protective cap is in the form of a vertical elongate hole on the narrow side thereof.

3. The pump assembly as claimed in claim 1 wherein in the rest portion of the actuating lever the outer side of the lever end is approximately flush with the outer contour of the protective cap.

4. The pump assembly as claimed in claim 1 or 16 wherein the horizontal cross section of the passage opening and protective cap widens toward the outside of the protective cap.

5. A pump assembly removably mounted to a liquid receptacle having a pump-type spray assembly secured thereto, which spray assembly contains an outlet opening for the liquid, said spray assembly comprising a protective cap having a top wall, a lower rim, and narrow and wide sides detachably secured to an upper portion of said receptacle and including therein a slidably supported actuating and dispensing head, said cap and dispensing head defining aligned outlet openings for the liquid, a pump actuating lever having a downwardly angled free lever end and a spray head engaging portion, means pivotally connecting the lever to said cap on the side of said cap opposite to the location of the free lever end of said pump actuating lever, which lever is positioned to engage said actuating and dispensing head upon pivotal movement thereof, said cap further defining an opening through which said lever extends, which opening corresponds approximately to the width of the actuating lever and extends from the lower rim of the protective cap at least as far as the top wall of the protective cap, through which the free lever end protrudes outward in its rest position, which opening is designed to prevent the lever from rotating while permitting pivotal movement thereof to actuate said dispensing head to spray liquid.

6. The pump assembly as claimed in claim 5 wherein the opening extends into the narrow side in the entire top wall of the cap to below the means pivotally mounting the actuating lever in the protective cap.

7. The pump assembly as claimed in claim 6 wherein in the rest position of the actuating lever the outer contour is approximately flush with that of the protective cap, with the exception of the free end of the lever which protrudes laterally through the slot.

* * * * *

UNITED STATES PATENT AND TRADEMARK OFFICE

CERTIFICATE OF CORRECTION

PATENT NO. : 5,249,713

DATED : October 5, 1993

INVENTOR(S) : Uwe Reich and Peter Runte

It is certified that error appears in the above-indentified patent and that said Letters Patent is hereby corrected as shown below:

Col. 5,

Claim 4, line 1, "16" should be --2--

Signed and Sealed this

Twelfth Day of April, 1994

Bruce Lehman

*Attest:*

BRUCE LEHMAN

*Attesting Officer*

*Commissioner of Patents and Trademarks*